US012222193B2

(12) United States Patent
Torroella

(10) Patent No.: US 12,222,193 B2
(45) Date of Patent: Feb. 11, 2025

(54) DETERRENT AND ELECTRICAL PULSE-APPLYING GLOVE DEVICE

(71) Applicant: SAS NETFORCE, Maugio (FR)

(72) Inventor: Sylvain Torroella, Agde (FR)

(73) Assignee: SAS NETFORCE, Mauguio (FR)

( * ) Notice: Subject to any disclaimer, the term of this patent is extended or adjusted under 35 U.S.C. 154(b) by 137 days.

(21) Appl. No.: 17/995,347

(22) PCT Filed: Mar. 12, 2021

(86) PCT No.: PCT/EP2021/056335

§ 371 (c)(1),
(2) Date: Oct. 3, 2022

(87) PCT Pub. No.: WO2022/188989

PCT Pub. Date: Sep. 15, 2022

(65) Prior Publication Data

US 2023/0152064 A1 May 18, 2023

(51) Int. Cl.
*F41H 13/00* (2006.01)
*A41D 19/00* (2006.01)

(52) U.S. Cl.
CPC ..... *F41H 13/0018* (2013.01); *A41D 19/0027* (2013.01)

(58) Field of Classification Search
CPC ..... A41D 19/0027; F41H 13/0018
USPC ..... 361/232
See application file for complete search history.

(56) References Cited

U.S. PATENT DOCUMENTS

| | | | | |
|---|---|---|---|---|
| 7,012,797 | B1 * | 3/2006 | Delida | F41H 13/0018 361/232 |
| 9,042,077 | B2 | 5/2015 | Jones et al. | |
| 10,254,077 | B2 | 4/2019 | Crandall | |
| 2004/0154071 | A1 * | 8/2004 | Frahm | A41D 19/0024 2/160 |
| 2004/0264099 | A1 * | 12/2004 | Sikes | H05C 1/06 361/232 |
| 2014/0022688 | A1 * | 1/2014 | Jones | F41H 13/0018 361/232 |
| 2017/0051998 | A1 * | 2/2017 | Crandall | F41H 13/0025 |

FOREIGN PATENT DOCUMENTS

| | | |
|---|---|---|
| CN | 204924055 U | 12/2015 |
| CN | 205037814 U | 2/2016 |
| WO | 2019086820 A1 | 5/2019 |

* cited by examiner

*Primary Examiner* — Kevin J Comber
(74) *Attorney, Agent, or Firm* — Craft Chu PLLC; Andrew W. Chu

(57) ABSTRACT

The deterrent and electrical pulse-applying glove device includes a palm side and a back-of-the-hand side with an external face and an internal face respectively external and internal to the glove device. The outer face of the palm side has installed on it at least two application contacts to be connected, by way of electrical connection devices. The electrical connection devices include at least one contactor, to an electric power source. The two application contacts are installed on the outer face on the palm side at a distance from one another so as to generate an electric arc between said contacts, when they are connected to the electric power source through the contactor to be actuated from the internal side internal to the glove device.

17 Claims, 3 Drawing Sheets

DETERRENT AND ELECTRICAL PULSE-APPLYING GLOVE DEVICE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a deterrent and electrical pulse-applying glove device of the type generally used in personal protection and safety applications.

2. Description of Related Art Including Information Disclosed Under 37 CFR 1.97 and 37 CFR 1.98

In the security field, devices of the taser type are known, making it possible, for personal safety, to apply electrical pulses to assailants or individuals deemed to be dangerous with a view to neutralizing them.

Unfortunately, this type of device generally applies uncontrolled electrical pulses, which can lead to accidents on the wearer or on the neutralized person.

Already known from document CN205037814U is a safety device in the form of a glove comprising two electrical conductors on a front face corresponding to the palm side of the hand, one of which electrical conductors extends from the base of the palm to the end of the thumb, middle finger and little finger, while the other conductor connects the ring finger to the index finger, passing through the palm. A power controller connects these conductors to a rechargeable battery.

Also known from document CN204924055U is a high-voltage electric shock glove of the order of 10,000 volts comprising, at the palm, two types of conductive fabric electrodes connected to an adequate power supply. These electrodes are covered with a first layer in the form of an insulating fabric and a second enveloping insulating layer made of polyester.

Similarly, document WO2019086820 discloses an electrical pulse-applying glove comprising an electrical energy source to which first application contacts arranged substantially at the ends of at least three glove fingers are connected through a control unit. The latter also comprises second application contacts arranged on the palm side of the glove, through which a greater electrical pulse can be applied than that which is applicable through the first application contacts at the fingertips. The control unit comprises selection means through which it is possible to activate, depending on the case, the contacts of the fingers or those of the palm of the glove. These contacts are still covered with a polyurethane safety coating to significantly reduce incidents of electric shock, but also to hide them so that they are not visible from the outside and to make the taser function more discreet.

While a glove device according to this state of the art makes it possible to easily modulate the intensity of the electric pulse according to the situation to be controlled, by activating the contacts at the fingers for a lesser discharge in comparison with what is possible through the contacts at the palm of the glove, it can be considered that the discharge produced by the contacts at the fingers essentially has a dissuasive purpose. However, for this dissuasive nature to be perceived by a threatening third party, physical contact must be established between the wearer of the glove and this third party.

Furthermore, the wearer of the glove must be able to make the contacts active according to the degree of risk with which he is faced. However, this risk is very difficult to change during a confrontation, not to mention that it can change very quickly, without there being sufficient time to modify the selection of active contacts.

Moreover, if, in an initial approach of a third party that is a priori aggressive, one may be tempted to activate the contacts in the fingers, the wearer of the glove must keep his fingers away from any part of his own body at all times to avoid getting shocked.

Also known from document US2004/0154071 is an electrical pulse-applying glove comprising a source of electrical energy to which two contacts are connected on the palm side, one of which is at the little finger of the glove and the another of which is at the thumb. More particularly, these contacts are capable of being powered by the electrical energy source through a contactor consisting of a first contact at the end of the glove finger corresponding to the index finger, on the back side of the glove, and a second contact at the end of the glove finger corresponding to the middle finger, on the palm side.

In short, to impart an electrical pulse to an assailant through the two contacts respectively on the little finger and the thumb, the wearer of the glove must at the same time make the contacts on the index and middle fingers coincide by bringing the latter above the former. Suffice to say that it can be very difficult, if not impossible, to successfully impart the electrical pulse in an intense altercation with an assailant.

This glove device according to this document US2004/015071 can also provide a deterrent effect by establishing an electric arc by bringing the contacts of the little finger and the index finger closer together. Obviously, apart from a power supply suitable for obtaining this electric arc, it is necessary, here again, for the contact to be established by bringing the contact of the middle finger onto that of the index finger.

This is a manipulation that is not natural and requires a certain dexterity. It is also more difficult to carry out instinctively and very quickly in the face of imminent danger.

BRIEF SUMMARY OF THE INVENTION

It was within the framework of a first inventive step that a glove device was conceived comprising, on the palm side, at least two contacts arranged at a predetermined distance from each other in order, in contact with an assailant and with a suitable power supply, to impart an electrical pulse to this assailant with a view to controlling him or, out of contact, to establishing a deterrent electric arc.

In a second inventive step, it has been conceived that the glove comprises a contactor for supplying electrical energy to the contacts that is designed to be active from the interior side of the glove.

Very particularly advantageously, this contactor is designed to be activated by powering up by extension of the body of the glove, preferably the palm side, and/or at least one glove finger.

The advantages of the present invention consist in the fact that the single natural gesture to be performed when faced with a threatening third party whom one wishes to keep at a distance, a gesture consisting in bringing the arm forward and opening the hand, results in the extension of the body of the glove, or even of the fingers of the glove, and the activation from inside this glove of the contactor for the electrical supply of the contacts and the establishment of the electric arc between them.

This natural gesture immediately generates a dissuasive signal through the glove according to the invention making it possible to keep said third party at a distance. In the event of an attack, the actuation of the contactor from inside the glove occurs just as naturally by contact of the wearer's hand on the assailant.

Thus, the invention relates to a deterrent and electrical pulse-applying glove device, comprising a palm side and a back-of-the-hand side with an external face and an internal face respectively external and internal to the glove device, the external face of the palm side having at least two application contacts installed thereon that are designed to be connected, by means of electrical connection means comprising at least one contactor, to an electrical power source, characterized in that two application contacts are installed on the external face on the palm side at a distance from one another that is determined so as to allow the establishment of an electric arc between them when they are connected to the electric power source through the contactor designed to be actuated from the internal side of the glove device.

According to a feature of the invention, an application contact comprises an electrode head projecting at the external face on the palm side.

Otherwise, yet another feature of the invention, the glove device may comprise a glove body provided or not provided with at least one glove finger, the two application contacts and tries a planter on the palm side at the glove body or a glove finger.

According to yet another feature of the invention, said electrical connection means comprise at least one high-voltage generator designed to deliver, from a low-voltage power supply delivered by the electric power source to the application contacts, a high-voltage power supply, between 220 and 5,000,000 volts.

Advantageously, the high-voltage generator is designed to deliver a high-voltage power supply, preferably greater than 5,000 volts, more particularly on the order of 20,000 volts.

Preferably, the contactor is of the impulse type installed on the internal face of the palm side of the glove device and designed to be actuated by the hand of the wearer of the glove.

BRIEF DESCRIPTION OF THE SEVERAL VIEWS OF THE DRAWINGS

Other particularities of the present invention will become apparent from the following description, which relates to an embodiment that is given only by way of indicative and non-limiting example.

The understanding of this description will be facilitated by referring to the appended figures.

DETAILED DESCRIPTION OF THE INVENTION

Figure 1:
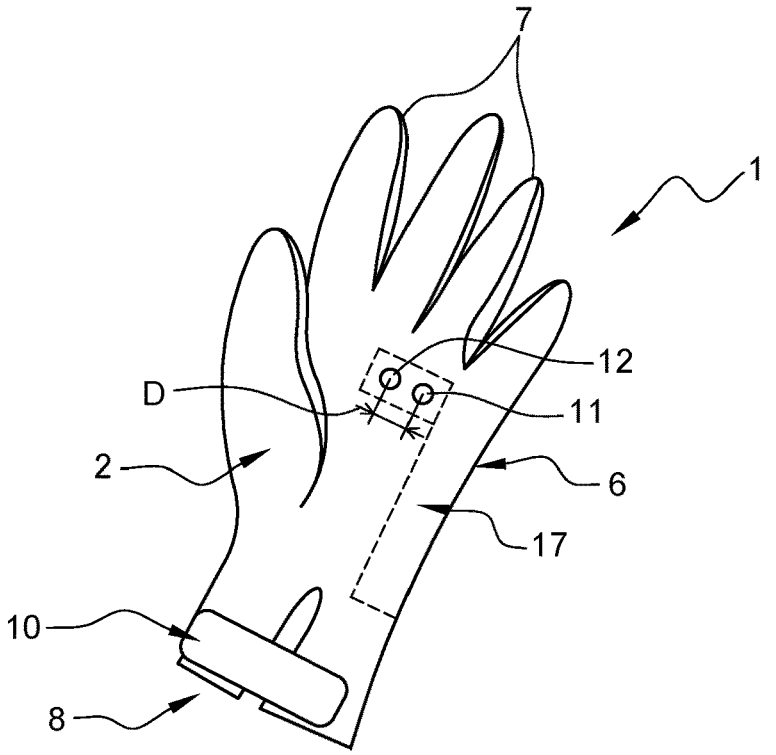
FIG. 1 is a schematic view, on the palm side, of a glove device according to the invention.
Figure 2:
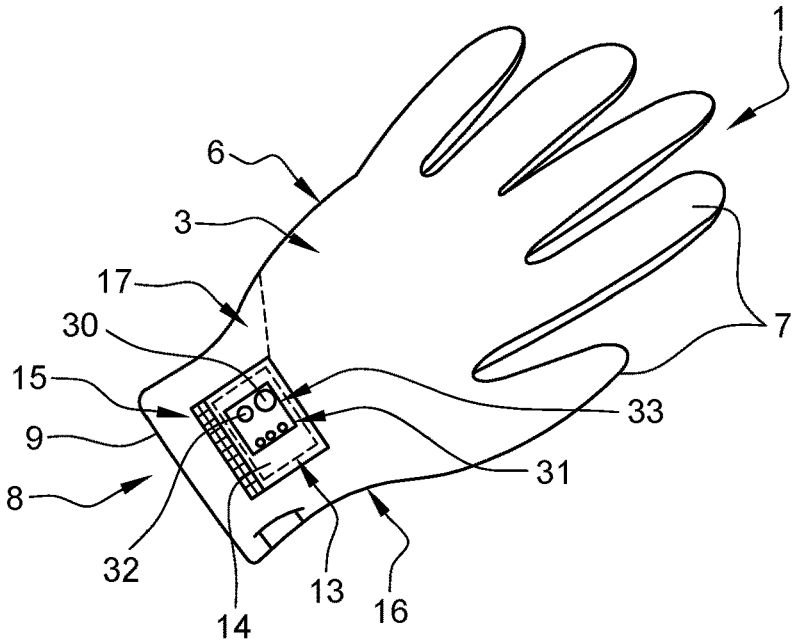
FIG. 2 is a schematic view similar to FIG. 1, showing the glove device seen from the back-of-the-hand side.

The invention relates to a deterrent and electrical pulse-applying glove device 1.

This type of glove device 1 is generally used in personal protection and safety applications. It is in particular a dissuasive device, and at the same time defensive device, that can make it possible to stun an assailant.

Its use can be intended for law enforcement, security personnel, or even for hospital personnel to control and contain a dangerous patient or one showing signs of aggression.

As illustrated in the appended figures, this glove device 1 comprises a palm side 2, or anterior face, and a back-of-the-hand side 3, or posterior face, each time with an external face 4 and an internal face 5.

It should be noted that the palm side defines the side of the glove device 1 corresponding to that of the palm of the hand of a wearer of this glove device. It extends over the entire anterior face of a wearer's hand, from the end of any fingers that the glove device comprises, to its opposite end at the wrist, or even beyond.

In the remainder of the description and to facilitate understanding, the expressions "palm side" and "back-of-the-hand side" will be used exclusively.

It essentially comprises a glove body 6 that may or may not be equipped with one or more glove fingers 7. In short, this glove device 1 can take the form of a mitten or that of a glove with glove fingers, the number of which can be between one and five.

At its end 8 comprising the opening 9 for engagement on the hand of a wearer of the glove device 1, the glove body 6 can be provided with closure means 10 to keep it closed and tightened on the wrist of this wearer. It can also be extended by a sleeve (not shown).

According to the invention, on the external face 4 of the palm side 3 of the glove device 1, at least two application contacts 11, 12 are installed that are designed to be connected to an electric power source 13.

Figure 3:
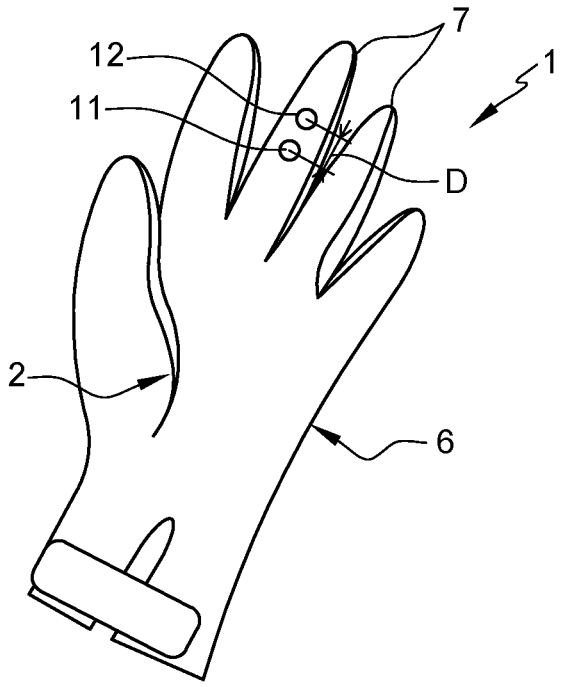
FIG. 3 is a schematic view similar to FIG. 1 showing the location of the application contacts at a finger of the glove device.

Thus, these application contacts 11, 12 can be installed on the external face 4 of the palm side 3, either at the glove body 6 as shown in FIG. 1, or along a glove finger 7 as shown in FIG. 3 if the glove device 1 is equipped therewith.

It should be noted that this FIG. 3 only illustrates a non-limiting example of this installation of the contacts at one of the fingers 7.

Preferably, the electric power source 13 is of the autonomous type and defined by at least one battery 14. This may be of the 3.7 V and 500 mAh lithium type, for example.

Advantageously, the glove device 1 comprises a receiving housing 15, in particular in the form of a pouch capable of being closed, to house this or these batteries therein. This receiving housing can be provided on the palm side 2 or on the back-of-the-hand side 3, preferably in the end part 16 intended to extend to the wrist of the wearer of the glove device 1.

The latter also comprises electrical connection means 17 for connecting the application contacts 11, 12 to such an electric power source 13. Substantially, such electrical connection means 17 comprise insulated electrical conductors (not shown) extending at least from the receiving housing 15 of the electric power source 13 to the application contacts 11, 12.

More particularly, these electrical conductors may extend internally to the glove device 1, advantageously between the latter and an internal lining 18.

Said electrical connection means 17 comprise at least one high-voltage generator designed to deliver, from a low-voltage power supply delivered by the electric power source 13 to the application contacts 11, 12, a high-voltage power supply, comprised between 220 and 5,000,000 volts.

Advantageously, the high-voltage generator is designed to deliver a high-voltage power supply, preferably greater than 5,000 volts, more particularly on the order of 20,000 volts.

At least the glove device 1 is made of a non-conductive insulating material to prevent the transmission of an electric pulse to the wearer. When an internal lining 18 is present, this is also made of non-conductive insulating material.

Furthermore, at least the glove body 6 and possibly the glove finger(s) 7 are made of a woven or non-woven material to resist cuts and/or fireproof to avoid the risk of burns.

This material can be based on carbon fibers, for example poly (p phenyleneterephthalamide), (PPD-T or KEVLAR™). The present invention cannot be interpreted in a limiting manner with respect to such a material.

According to the invention, two application contacts 11, 12 are installed on the external face 4 of the palm side 3 of the glove device 1, at a distance D from one another that is determined so as to allow the establishment of an electric arc between them when they are connected to the electric power source 13 through said electrical connection means 17.

According to the invention, the glove device 1 is capable of being provided with several pairs of contacts corresponding to this feature.

According to another feature of the invention, these electrical connection means 17 comprise at least one contactor 19 to ensure the supply of electrical energy to the application contacts 11, 12 by the power source 13. This contactor 19 is designed to be actuated from the internal side 20 of the glove device 1.

In particular, this contactor 19 is designed to be activated by powering up by extension of the glove body 6, preferably on its palm side 2, and/or at least one glove finger 7.

According to one embodiment, this contactor 19 is of the pulse type and comprises a push button 21 pushed back, by elastic return means, inside the glove device 1 into an inactive power cutoff position 22. Conversely, pressure in the opposite direction in an active position 23, against the elastic return means, results in establishing the supply of the contacts 11, 12.

Figure 4:
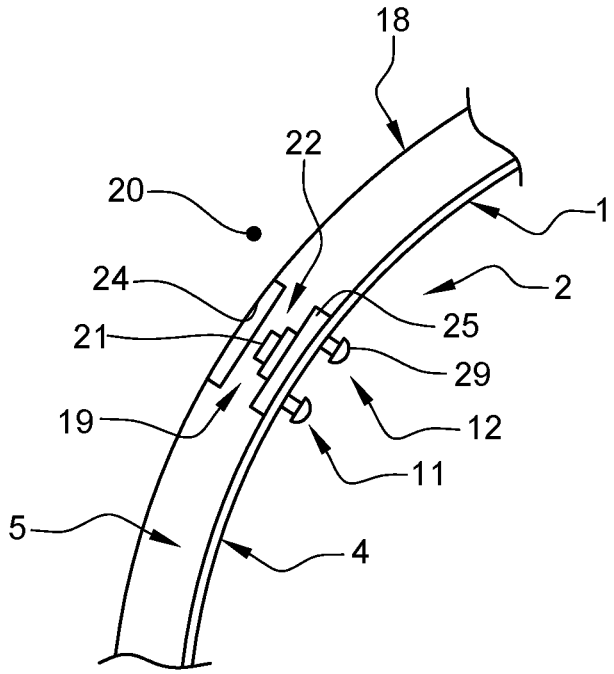
FIG. 4 is a schematic sectional view of the glove device at the application contacts showing the contactor in the inactive position.
Figure 5:
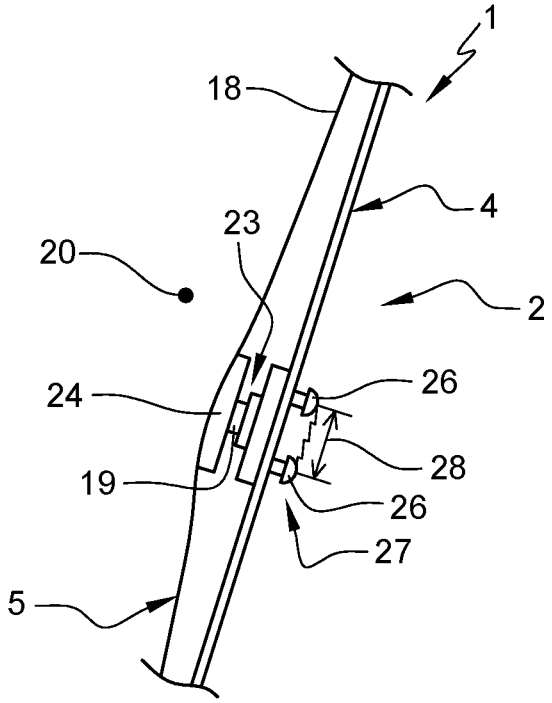
FIG. 5 is a schematic sectional view similar to FIG. 4 showing the contactor in the active position for supplying the application contacts.

By installing, for example, the application contacts 11, 12 at the external face 4 of the glove body 6, the contactor 19 can be arranged at the rear of these application contacts 11, 12, at the internal face 5 of this glove body 6. Thus, in a deterrent application of the glove device 1 and as visible in FIGS. 4 and 5, stretching the palm side 2 of the glove device 1, simply consisting for the wearer in opening his hand, results in a tensioning of the palm side 3 of this glove body 6. This is pressed, at its internal face 5, against the palm of the wearer's hand, which pushes the push button 21 for supplying the contacts 11, 12 back into the active position 23.

Conversely, by closing the wearer's hand, the tension on the palm side 2 of the glove device 1 is released, allowing the push button 21 to return to its inactive position 22 via said elastic return means and the power supply application contacts 11, 12 to be cut off.

Consequently, when an assailant approaches, the wearer of the glove device 1 can open his hand in the direction of this assailant, resulting in the activation of the contactor 19. Since the application contacts 11, 12 are supplied with power, they generate an electric arc between them that is visible to the assailant so as to dissuade him from approaching further, while informing him that he is likely to receive a high-intensity electric pulse in case of aggression.

In this regard, it is understood that in case of contact and application of the palm side 2 of the glove device 1 on the assailant, the internal face 4 of this palm side 2 comes to rest against the wearer's hand. The push button 21 is then pushed back from its inactive position 22 into its active position 23, resulting in the power supply of the application contacts 11, 12 and the automatic application of an electric pulse to the attacker.

The same result can be obtained by installing the two application contacts 11, 12 on the palm side 2 of a glove finger 7. In this case, the contactor 19 can keep its location at the glove body 6, as in the example below, or it can be positioned under the application contacts 11, 12 at this glove finger 7, on the internal side 20 of the glove device 1. Opening the wearer's hand and/or finger has the same consequences.

To facilitate the control of the contactor 19 from the internal side 20 of the glove device 1, in line with this push button 21, the internal lining 20 can be equipped with a control plate 24 of section greater than that of this push button 21. In this way, a pressure that would not necessarily be applied in line with this push button 21 by the palm of the wearer's hand still has the consequence of pushing it back from its inactive position 22 to its active position 23.

According to an advantageous embodiment, the application contacts 11, 12 are mounted on a support plate 25 to which the electrical connection means 17 lead. While this support plate 25 can be provided, by sewing, welding or the like, in a suitable opening on the palm side 2 of the glove device 1, it is advantageously arranged at the internal face 5, preferably between the latter and the internal lining 18. Said application contacts 11, 12 in this case pass through the glove device 1 to be arranged on the external face 4, on the palm side 2 thereof.

This support plate 25 can still be equipped with the contactor 19, so that the push button 21 extends on the internal side 20 of the glove device 1.

The support plate 25 can take the form of a printed circuit board.

An application contact 11, 12 advantageously comprises an electrode head 26 projecting at the external face 4 on the palm side 2 of the glove device 1.

These electrode heads 26 are designed to define, in their projecting part 27, a preferential path for establishing the electric arc between the application contacts 11, 12.

Concretely, these electrode heads 26 of the application contacts 11, 12 define, at their projecting part 27, the smallest distance 28 between the application contacts 11, 12.

According to a preferred embodiment, these electrode heads 26 have a T or mushroom shape and have a larger section at their projecting end 29.

Advantageously again, the glove device 1 comprises a control switch 30 to activate it or, on the contrary, to deactivate it, as required.

It can also be equipped with load control means 31 of the electrical energy source 13. According to the invention, it also receives an operating indicator 32

The control switch 30 and/or the load control means 31 and/or the operating indicator 32 can be installed at a control panel 33 capable of being positioned on the palm side 2 or the back-of-the-hand side 3 of the glove device 1, preferably at the end 8, on the wearer's wrist side.

According to the invention, the glove device 1 can receive additional equipment, such as at least one sensor of the state of health of the wearer of the glove device 1, for example a voltage and/or pulse sensor.

In a more advanced design, the glove device 1 comprises remote transmission means, either directly or through a unit connected to an Internet or communication network, such as a mobile telephone, for example.

Such transmission means make it possible to transmit, periodically, continuously or occasionally, information transmitted by a sensor of the wearer's state of health to a central unit.

The glove device 1 can receive an alert device allowing the wearer to emit a signal through the transmission means to call for help or reinforcement.

The glove device 1 can also be equipped with a GPS tracker making it possible to locate the glove wearer, as the case may be continuously or at the command of the glove wearer, for example through the alert device.

We claim:

1. A deterrent and electrical pulse-applying glove device, comprising:

a glove body having an external face and an internal face, said external face having a palm side and a back-of-the-hand side opposite said palm side;

an internal lining on said internal face;

two application contacts installed on said palm side of said external face; and an electrical connection means to an electrical power source for the two application contacts, the electrical connection means being installed on said internal face, wherein the electrical connection means is comprised of:

a contactor connected to said two application contacts between said internal lining and said glove body, wherein said contactor is comprised of a push button between said internal lining and said glove body, said push button having an inactive position and an active position, wherein said electrical power source, said contactor, and said two application contacts are at a distance from one another and are connected so as to generate an electric arc between said two application contacts with said push button in said active position, and wherein a portion of said internal lining is aligned with the electrical connection means so as to actuate said push button between said inactive position and said active position by pressure from said internal lining toward said two application contacts when said glove body is extended from a closed hand position to an opened hand position.

2. The glove device, according to claim 1, wherein the glove body comprises at least one glove finger.

3. The glove device, according to claim 1, wherein the electric power source is of the autonomous type and defined by at least one battery.

4. The glove device, according to claim 3, further comprising:

a receiving housing being comprised of a pouch, the at least one battery being housed in said pouch.

5. The glove device, according to claim 4, wherein the electrical connection means is further comprised of insulated electrical conductors extending from said receiving housing to said two application contacts.

6. The glove device, according to claim 1, wherein the contactor is of the pulse type, and wherein said push button is comprised of an elastic return means so as to actuate between said inactive position and said active position.

7. The glove device, according to claim 6, further comprising: a control plate on said portion of said internal lining.

8. The glove device, according to claim 1, wherein the electrical connection means is further comprised of a support plate on said internal face connected to said two application contacts.

9. The glove device, according to claim 8, wherein said contactor is comprised of said support plate.

10. The glove device, according to claim 1, wherein each application contact of said two application contacts is comprised of an electrode head projecting from said external face on palm side.

11. The glove device, according to claim 10, wherein the respective electrode head of each application contact of said two application contacts are at a distant from each other so as to define a preferential path for said electric arc.

12. The glove device, according to claim 10, wherein the respective electrode head of each application contact of said two application contacts have a T or mushroom shape.

13. The glove device, according to claim 1, further comprising: control panel, said control panel being comprised of at least one of a group consisting of: a control switch, an electrical energy load control means, and an operating indicator.

14. The glove device, according to claim 1, further comprising: at least one sensor connected to said electrical power source so as to detect a state of health of a wearer of said glove body.

15. The glove device, according to claim 1, further comprising: a remote transmitter for an Internet or communication network.

16. The glove device, according to claim 1, further comprising: an alert device.

17. The glove device, according to claim 1, further comprising: a GPS tracker.

* * * * *